United States Patent [19]

Grady

[11] 4,198,113

[45] Apr. 15, 1980

[54] TERMINAL MEMBER

[75] Inventor: James J. Grady, Somerworth, N.H.

[73] Assignee: General Electric Company, Somerworth, N.H.

[21] Appl. No.: 737,677

[22] Filed: Nov. 1, 1976

[51] Int. Cl.[2] ..... H01R 13/40

[52] U.S. Cl. ..... 339/221 R; 339/276 A

[58] Field of Search ..... 339/220, 221, 252, 276

[56] References Cited

U.S. PATENT DOCUMENTS

| | | | |
|---|---|---|---|
| 2,667,624 | 1/1954 | Bels | 339/220 C |
| 3,359,520 | 12/1967 | Foerster | 339/276 R |
| 3,400,358 | 9/1968 | Byrnes et al. | 339/252 P |

FOREIGN PATENT DOCUMENTS

| | | | |
|---|---|---|---|
| 618961 | 12/1926 | France | 339/252 P |

*Primary Examiner*—Joseph H. McGlynn

*Attorney, Agent, or Firm*—Robert E. Brunson; Francis X. Doyle

[57] ABSTRACT

A self-locking and aligning terminal member for affixing electrical wires to a device such as a coil, comprising a smooth surfaced rod bent approximately 180° upon itself to provide a pair of generally parallel leg sections extending from the bend and with each terminating in an outward projecting flare forming barbs to lock the member within a receiving recess. The parallel leg sections of the terminal member are provided with a laterally bowed section adjacent the bend for receiving the electrical conducting wires adjoined thereby, and an outwardly bowed section adjacent the outward projecting flare forming barbs for positioning the terminal member within a receiving recess.

4 Claims, 3 Drawing Figures

TERMINAL MEMBER

BACKGROUND OF THE INVENTION

Terminal connecting members or mounts are often used for affixing or physically securing very small diameter magnet wires to terminal leads or power wires, which typically are relatively heavy or large diameter, in the assembly or manufacture of certain electric devices such as electrical coils. The terminal connecting means in such devices are a prime cause or source of rejects or product failure because of very high incidence of breakage of the fine diameter magnet wire at or adjacent the terminal connection, and/or because of dislocation of the terminal means with the wires attached thereto.

For instance, in a typical encapsulated potential coil, the very fine magnet wire of the coil, for example, about 0.0045 of an inch in diameter, is extended to and applied with several loops around a terminal member or mount, such as the conventional prior art terminal member shown in the drawing, for connection with a lead or wire supplying energizing electrical power. The relatively larger terminal lead or power wire, illustrated in the drawing, is superimposed over the applied loops of the fine magnet wire around the terminal member to thereby make electrical contact, and the thus arranged wires or conductors are permanently affixed or physically secured to each other and the terminal member by soldering, or other appropriate electrical connecting means.

In addition to the relatively fragile nature of wire of such fine diameter as the magnet wire commonly used in coils and other electrical devices, one common type of conventional prior art terminal member, such as illustrated in the drawing, is produced by stamping the unit from sheet metal stock. Such prior terminal members which are formed by stamping have edges which are rough and irregular, and frequently contain burrs, undulations and sharp portions. Thus, the fine, fragile magnet wire looped around the terminal member is very easily severed by any sharp or irregular surface or edge portions, and is particularly subject to breakage when pulled taut or otherwise in contact therewith under force.

Moreover, this potential or occurrence of breakage of the fine magnet wire resulting from its severance by the terminal member is very often increased by an encapsulation procedure. The application of an encapsulating plastic dielectric coating or covering on the coil by means of a hot thermoplastic melt frequently introduces or increases tension in, or creates other detrimental physical forces upon the portion of the magnet wire leading to and/or looped around the terminal member, or upon the terminal member itself with the wire affixed thereon.

For instance, the viscosity of such molten encapsulating materials is frequently relatively high and rapidly increases with the fast rate of cooling due to the heat sink effect of the metal coil or other device undergoing encapsulation, or other rapid temperature reducing influences. Thus, the encapsulating operation or materials tend to introduce or accentuate tension or compression forces acting upon the fine magnet wire, and/or upon the terminal member with the wires affixed thereto with the likely movement or dislocation of the overall terminal, carrying the wires with it. Additionally, a dislocated terminal member, due to a failure of its positioning and/or securing means, can result in faulty or insufficient encapsulation or coating of the entire device, including the wires or terminal member.

SUMMARY OF THE INVENTION

This invention comprises a new and improved self-positioning and self-locking terminal member for affixing terminal lead or power wires to an electrical device and in electrical contact with the fine magnet wire thereof. The terminal member of this invention comprises an elongated metal body, such as a rod or rigid wire of relatively large diameter, which is bent upon itself to provide a closed end with a pair of generally parallel leg sections or runners extending therefrom which terminate with an outward flared open end. The pair of generally parallel leg sections or runners are further provided with a unique configuration which performs several distinct functions and provides multiple advantages.

OBJECTS OF THE INVENTION

It is a primary object of this invention to provide an improved terminal member for affixing or securing very small diameter wires to relatively large diameter terminal leads or power wires in electrical devices such as coils, which effectively minimizes or precludes breakage of the very thin wires and other causes of rejects or product failure.

It is also an object of this invention to provide an improved terminal member for affixing or securing very thin wires to relatively large diameter terminal leads or power supply wires in electrical devices such as coils which is self-positioning and self-locking in position within an appropriately dimensioned recess or pocket provided or formed within the structure of the electrical device employing the terminal member.

It is a further object of this invention to provide an improved terminal member for affixing or securing of very small diameter wires to relatively large diameter terminal leads or power supply wires in electrical devices such as coils having a construction that ensures the positive and accurate positioning and electrical connection of the wires or leads that are joined.

It is a still further object of this invention to provide an improved terminal member for affixing or securing fine wires to relatively large diameter terminal leads or power supply wires in electrical devices such as coils which is free of burrs, and rough, irregular, or sharp edges or portions, or other physical conditions which can be detrimental to the integrity of or a cause of breakage for the wires affixed or secured therewith.

DESCRIPTION OF A PREFERRED EMBODIMENT

Figure 4:
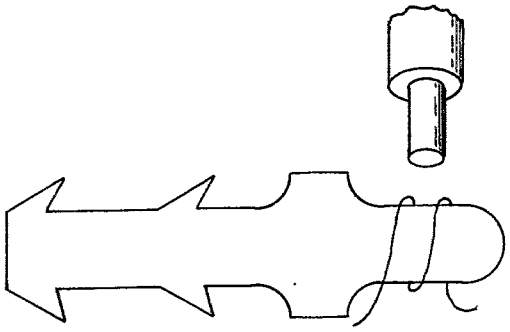
PRIOR ART FIG. 4
FIG. 4 is an illustration of a common type of prior art terminal member, which is identified in the drawing as prior art.

As noted above, one common type of prior art terminal member for affixing very small diameter or fine wire to relatively large diameter terminal leads or power supply wires in electrical devices such as potential coils, is shown in the drawing, labeled "Prior Art". This type of common terminal member was economically produced by stamping the configuration thereof from sheet metal stock. However, this simple, low cost means of manufacture resulted in burred, rough or sharp edges about the stamped shape which tend to sever the fine magnet wire and thus produce rejects or cause failure in the performance of the device incorporating the terminal member. Moreover, it was not economical or practical to remove these imperfections attributable to the stamping manufacturing technique from the product.

The prior art terminal member shown in the drawing is provided with fixed or inflexible barbs to resist dislodgement of the member from a retaining recess or pocket in an electrical device, and has a portion adjacent to the end thereof opposite the barbs designed for the looping thereabout of the magnet wire and superimposing thereon of a heavier terminal lead for soldering to connect and affix the components.

Figure 1:
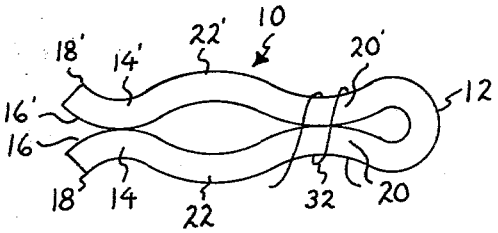
FIG. 1 of the drawing is a plan view of the terminal member of this invention.
Figure 2:
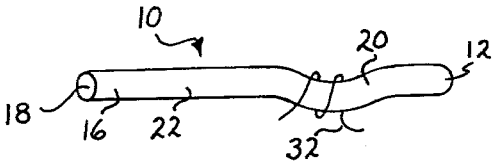
FIG. 2 of the drawing is a side view of the terminal member of FIG. 1.

In accordance with this invention, and referring specifically to FIGS. 1 and 2 of the drawing, the new terminal member 10 thereof comprises an elongated metal body or unit such as a resilient rod or a rigid and relatively large diameter wire, having a generally rounded or non-angular cross-section with a burr-free, and substantially smooth surface. The elongated metal body of the terminal member 10 is provided with a bend 12 therein of approximately 180°, forming a generally U-shaped configuration of a bent closed end with a pair of leg sections or runners 14 and 14' extending from the bend 12, or closed end formed thereby. The pair of leg sections 14 and 14' extend from the bend 12 generally parallel to each other, and are in adjoining contact with each other along a portion or portions of their lengths, as shown. The elongated metal body forming the terminal member 10 of this invention, is bent upon itself to approximately 180° at about the middle of its length and is shaped as described hereinafter and illustrated in the drawing to a substantially symmetrical configuration with each leg section or runner 14 and 14' thereof forming a corresponding counterpart or mirror-image of the other.

The leg sections or runners 14 and 14', both terminate or end with an outward extending flared portion 16 and 16' directed opposite from each other to thereby form a pair of outwardly projecting barbs 18 and 18' at the end of each leg section. The flared portion with ends thereof providing the barbs 18 and 18', due to the inherent resiliency of the relatively rigid metal and the configuration of the member, will slightly compress with a moderate force for entry into an appropriately sized recess or pocket, whereupon the flared portion tends to resume their former arrangement and the barbs thus embed into and grip the walls of the recess or pocket and resist moving therefrom.

Moreover, by terminating the ends of each leg section or runner 14 with a transverse square cut of about 90° to their longitudinal axis, such as shown in the drawing, the approximately 90° angular edge formed thereby provides a sharp barbed point for cutting into the surface of a mounting recess or pocket to thereby firmly anchor the terminal member 10 in position.

Each of the parallel extending leg sections 14 and 14' is provided with a lateral bowed portion 20 and 20' which bows or projects in the same direction in both leg sections 14 at a location approximately adjacent to the bend 12 forming the closed end of the terminal member 10, and at the designed site for looping the fine magnet wire around the terminal member. This lateral bowed portion 20, forms a depression in the terminal member providing for the positive and accurate positioning of the relatively large diameter terminal lead or power wire for connection with the magnet wire.

Additionally, both parallel extending leg sections 14 and 14' are provided with oppositely bowed portions 22 and 22' which projects outwardly apart from each other in directions perpendicular to the direction of the lateral bow 20 and at a location approximately adjacent to the terminating flared portion 16 and 16' of the open end. This oppositely bowed portions 22 and 22', forming an outward expansion, provide for positive and accurate alignment, or designed positioning and retention of the terminal member 10 within an appropriately dimensioned recess or pocket. Thus, the location of the terminal member 10 and the wires affixed and connected thereon can be accurately and firmly located in their designated arrangement for subsequent manufacturing operations or ultimate service, such as encapsulation and/or assembly of the device in an electrical apparatus.

Figure 3:
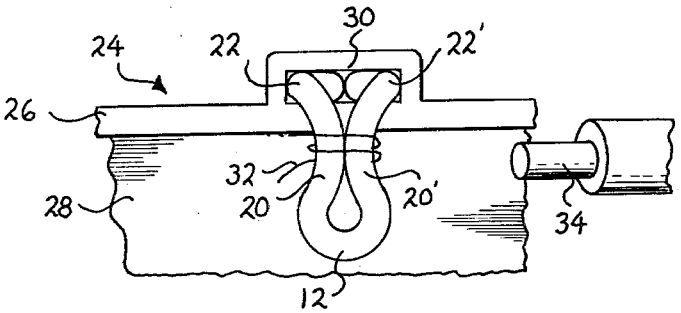
FIG. 3 of the drawing shows a portion of an electrical coil with the terminal member of this invention positioned and locked in a recess provided in a flange of the coil.

In accordance with this invention, the above-described, new terminal member 10 is attached to an electrical device, such as an electrical coil 24, shown in part in FIG. 3 of the drawing. Coil 24, for example, comprises a coil spool of conventional construction including a shaft (not shown) with a pair of end flanges (one flange 26 shown) composed of a suitable dielectric plastic material, containing windings of fine magnet wire 28 thereabout. A flange 26, or other apt structure of the coil 24, or other electrical device, is provided with a recess or pocket 30 of appropriate dimensions to closely receive the barbed open end of the terminal member 10 with a forced fit. The oppositely bowed portions 22 and 22' of the terminal member 10 positively and accurately align and position the terminal member in its designated arrangement, and the barbs 18 and 18' securely anchor the terminal member 10 firmly in place within the recess 30, such as can be provided in a flange 26 of a coil 24. If appropriate, a portion of the installed terminal member which projects outward well beyond the mounting recess 30, can be folded, such as by bending, approximately 45° to thereby extend the projecting portion from the location of the mounting recess in a direction adjacent to the face of the coil, such as shown in FIG. 3 of the drawing.

An end portion of the fine diameter magnet wire 32, such as from the coil winding 28, is looped firmly several times around the attached terminal member 10 in the location of the lateral bowed portion 20 thereof, as shown. The end portion of a relatively larger terminal lead or power wire 34, stripped of any insulation, is placed within the depression formed by the lateral bowed portion 20, overlying the loops of magnet wire around the terminal member, preferably arranged generally at about a right angle to the leg sections 14 and 14' to optimize the cradling effect of the recess, and therein permanently joined in electrical contact with the magnet wire 32 and the supporting terminal member 10, such as by soldering.

Thereafter, the composite assemblage of the coil 24 with the attached terminal member 10 and affixed terminal lead connected to the magnet wire winding, can be encapsulated either by immersing of the assemblage in a bath of the coating material or by confining of the assemblage in a mold chamber with the coating material such as a molten thermoplastic resin thereabout.

The construction of the terminal member of this invention aptly positions itself within an attaching recess and firmly resists dislocation therefrom withstanding the forces of the encapsulating material applied thereover and thereby precludes the introduction or any increase of damaging tension or compressive forces due to its movement.

Although the invention has been described with reference to certain specific embodiments thereof, numerous modifications are possible and it is desired to cover all modifications falling within the spirit and scope of this invention.

What I claim as new and desire to secure by Letters Patent of the United States is:

1. A terminal member for securing electrical wire to a device which is self-aligning and self-locking upon entry into an appropriately sized recess, comprising an elongated metal body shaped to a substantially symmetrical configuration having a bend therein of approximately 180° and a pair of generally parallel leg sections extending from said bend which are in adjoining contact with each other along portions of their lengths and each leg section terminating with an upward projecting resilient flared portion directed opposite from each other for resiliently gripping the walls of a recess, both of said parallel extending leg sections each having formed therein a laterally bowed portion projecting in the same direction at a location approximately adjacent to the bend and thereby forming a depression for receiving an electrical conductor wire, and each leg section having a bowed section projecting outwardly apart from the other at a location approximately adjacent the terminating flared portion and thereby forming an outward expansion for aligning the terminal member upon entry into a recess.

2. A terminal member for securing electrical wire to a device which is self-aligning and self-locking upon entry into an appropriately sized recess, comprising an elongated metal rod shaped to a substantially symmetrical configuration having a bend therein of approximately 180° providing a closed end and a pair of generally parallel leg sections extending from said bend and which are in adjoining contact with each other along portions of their lengths and each leg section terminating with an outward projecting resilient flared portion directed outward opposite from the other to form barbs and providing an open end for resiliently gripping the walls of a recess, both of said parallel extending leg sections each having formed therein a laterally bowed portion projecting in the same direction at a location approximately adjacent to the closed end and thereby forming a depression for receiving an electrical conductor wire, and each leg section having a bowed section projecting outwardly apart from the other at a location approximately adjacent the open end and thereby forming an outward expansion for aligning the terminal member upon entry into a recess.

3. A terminal member for securing electrical wire to a device which is self-aligning and self-locking upon entry into an appropriately sized recess, comprising an elongated metal body having a non-angular cross-section and smooth, burr-free surface shaped to a substantially symmetrical configuration having a bend therein of approximately 180° and a pair of generally parallel leg sections extending from said bend which are in adjoining contact with each other along portions of their lengths and each leg section terminating with an outward projecting resilient flared portion directed opposite from each other for resiliently gripping the walls of a recess, both of said parallel extending leg sections each having formed therein a laterally bowed portion projecting in the same direction at a location approximately adjacent to the bend and thereby forming a depression for receiving an electrical conductor wire, and with each leg section having a bowed section projecting outwardly apart from the other at a location approximately adjacent the terminating flared portion and thereby forming an outward expansion for aligning the terminal member upon entry into a recess.

4. A terminal member for securing electrical wire to a device which is self-aligning and self-locking upon entry into an appropriately sized recess, comprising an elongated metal rod having a round cross-section and smooth, burr-free surface shaped to a substantially symmetrical configuration having a bend therein of approximately 180° providing a closed end and a pair of generally parallel leg sections extending from said bend and which are in adjoining contact with each other along portions of their lengths and each leg section terminating with an outward projecting resilient flared portion directed outward opposite from the other for resiliently gripping the walls of recess to form barbs and providing an open end, both of said parallel extending leg sections each having formed therein a laterally bowed projecting in the same direction at a location approximately adjacent to the closed end and thereby forming a depression for receiving an electrical conductor wire, and each leg section having a bowed section projecting outwardly apart from the other at a location approximately adjacent the open end and thereby forming an outward expansion for aligning the terminal member upon entry into a recess.

* * * * *